United States Patent [19]

Libby et al.

[11] Patent Number: 4,850,078

[45] Date of Patent: Jul. 25, 1989

[54] ADJUSTABLE ROLLER ASSEMBLY FOR SLIDING DOORS

[75] Inventors: Scott A. Libby, Eau Claire, Wis.; Frank V. Pliml, Jr., Arlington Heights, Ill.; William M. Johnson, Rice Lake; Laurence P. Armstrong, Weyerhaeuser, both of Wis.; James L. Peterson, Aurora, Ill.

[73] Assignee: Nichols-Homeshield, Inc., Rice Lake, Wis.

[21] Appl. No.: 260,871

[22] Filed: Oct. 21, 1988

[51] Int. Cl.[4] ..... E05D 13/00

[52] U.S. Cl. ..... 16/100; 16/105

[58] Field of Search ..... 16/99, 100, 105; 49/425

[56] References Cited

U.S. PATENT DOCUMENTS 2,990,567 7/1961 Pearson ..... 16/105
3,416,183 12/1968 Martin ..... 16/105
3,698,036 10/1972 Goodman ..... 16/100
4,030,160 6/1977 Lambertz ..... 16/105

*Primary Examiner*—Nicholas P. Godici
*Assistant Examiner*—Carmine Cuda
*Attorney, Agent, or Firm*—Mann, McWilliams, Zummer and Sweeney

[57] ABSTRACT

An adjustable roller assembly for sliding doors including a housing adapted to be snap-fit into a recess provided in the upper or lower surface of a door frame, the housing defining a cavity which is open at the lower end. A roller carrier is mounted in the housing cavity and is vertically adjustable with respect to the housing. The lower end of the roller carrier defines circular flanges in which is rotatably mounted a roller having an integral hub. A camming arrangement associated with the roller carrier is accessible for adjustment from the side of the door frame and is operable to adjust the vertical position of the roller carrier and roller to adjust the slack between the door and the track upon which the roller is adapted to ride.

4 Claims, 2 Drawing Sheets

ADJUSTABLE ROLLER ASSEMBLY FOR SLIDING DOORS

BACKGROUND OF THE INVENTION

The present invention provides an adjustable roller assembly for doors which slide on tracks. The adjustment mechanism can be used to take up slack after the door is installed on a track. Numerous arrangements of this general type are shown in U.S. Pat. Nos. 2,990,567, 3,237,238, 3,716,890, 4,134,178, 4,189,870 and 4,353,186. None of these patents discloses the features of the present invention.

SUMMARY OF THE INVENTION

The present invention provides an adjustable roller assembly for sliding doors. The assembly includes a housing adapted to be mounted in a recess provided at the upper or lower edge of a sliding door. The housing may be snap-fit into the slot in the door edge. The housing defines a cavity therein which is open at the lower end thereof. A roller carrier is mounted in the cavity and is vertically adjustable with respect to the housing. The roller carrier defines circular flanges at its lower end. A roller having an integral hub is rotatably mounted in the carrier, the hub supported by the circular flanges. A camming element associated with the roller carrier is disposed at the upper end of the housing. The camming element is provided with gear teeth which engage and cooperate with a threaded stem extending through the top of the housing. One end of the threaded stem extends through the side of the door. A slot adapted to receive a screwdriver is provided in the end of the stem. Vertical adjustment of the roller with respect to the housing may be achieved by rotating the stem which rotates the camming element and effects vertical adjustment of the roller carrier and roller.

DETAILED DESCRIPTION OF THE INVENTION

Figure 2:
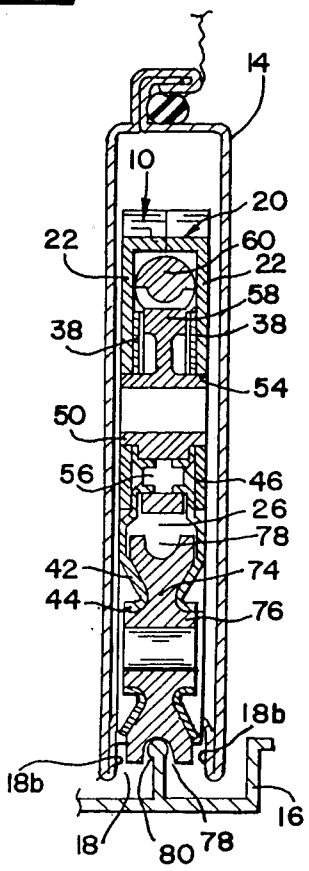
FIG. 2 is a cross-sectional side view taken along line 2—2 shown in FIG. 1.
Figure 1:
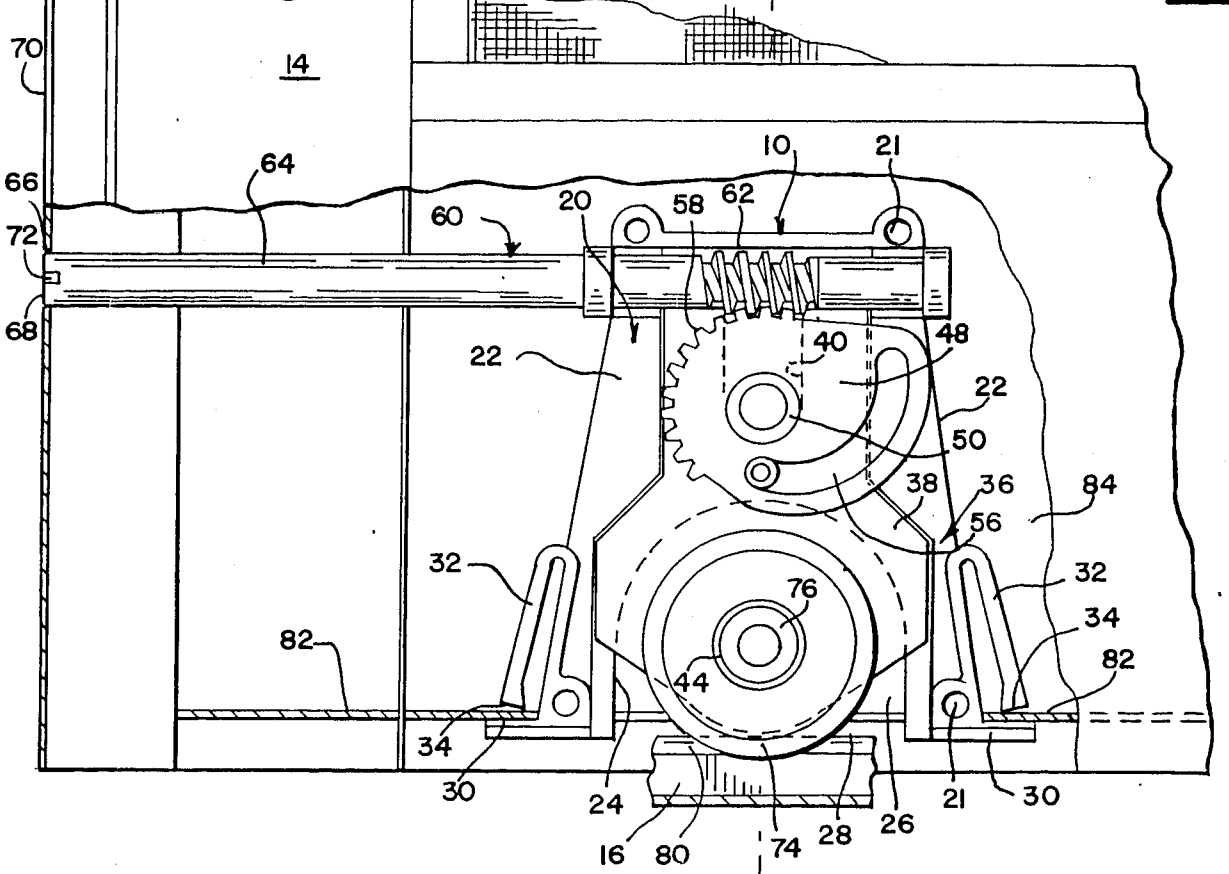
FIG. 1 is a front view, partially broken away, of the roller assembly of the present invention installed in a door frame with the roller raised vertically with respect to the assembly housing.
Figures 3, 4:
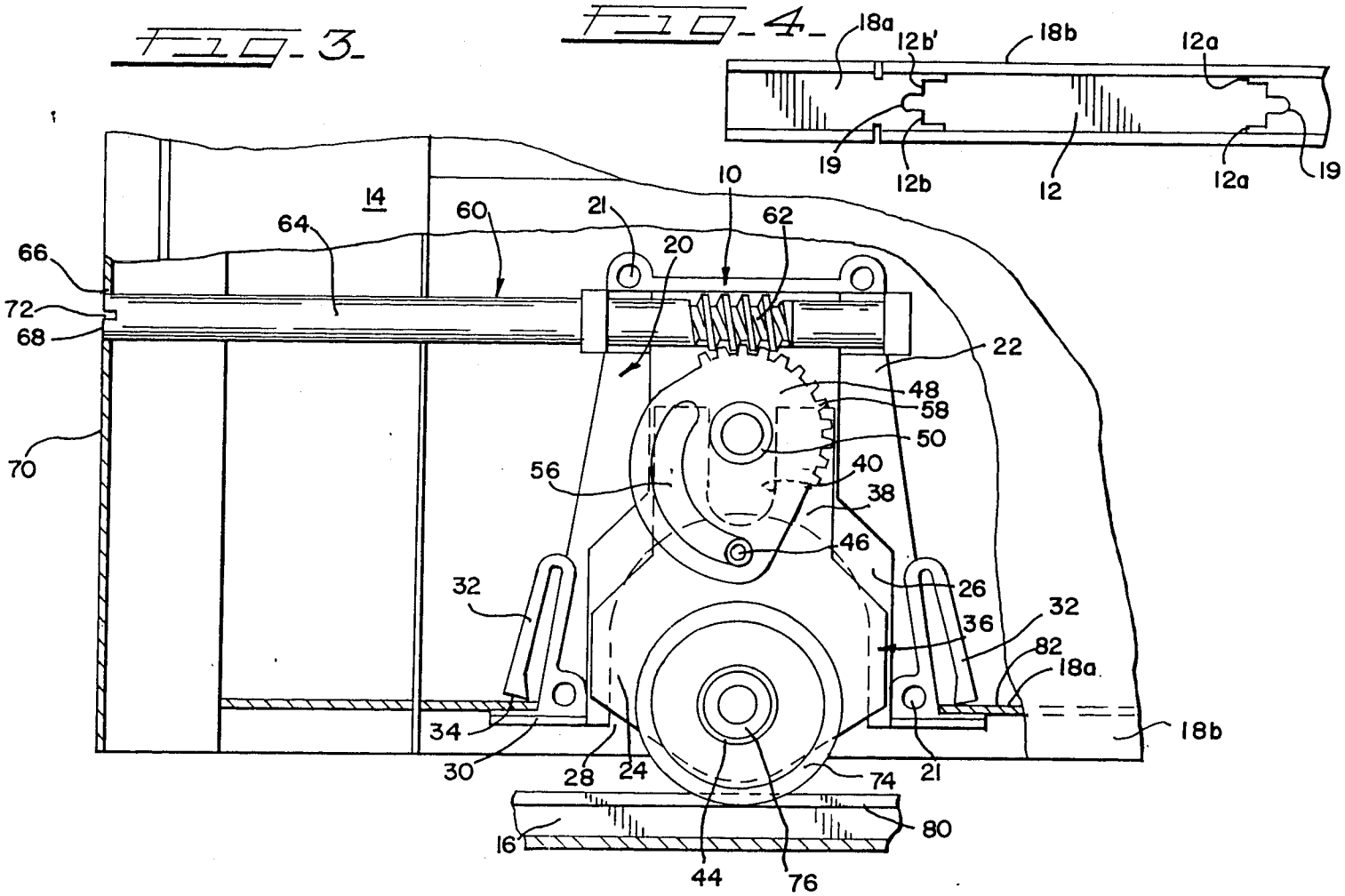
FIG. 3 is a front view, partially broken away, of the roller assembly shown in FIG. 1 with the roller lowered vertically with respect to the assembly housing.
FIG. 4 is a bottom view of the slot in the door frame into which the roller assembly of the present invention is inserted.

An adjustable roller assembly, generally designated by the numeral 10, is shown in FIGS. 1–3. The roller assembly 10 is adapted to be mounted in a recess or slot 12 provided in an upper or lower edge of a door frame 14 for sliding on a track 16 extending the width of the door frame. The roller assembly 10 in FIGS. 1–3 is shown installed in the lower edge of a door frame 14.

The door frame edge defines a generally inverted U-shaped recess 18 having a flat bottom surface 18*a*, shown in FIG. 4, and a pair of side walls 18*b*, best shown in FIG. 2, depending downwardly therefrom. The slot 12 is defined in the flat surface 18*a*. As best seen in FIG. 4, each end of the slot 12 defines a pair of first shoulders 12*a* and a pair of second shoulders 12*b*. Defined between each pair of second shoulders 12*b* is a generally arcuate-shaped notch 19. The significance of the configuration of the slot 12 will become apparent below.

The roller assembly 10 includes a housing 20 comprising a pair of opposing corresponding walls 22 joined together in any appropriate manner, as for example, by pins 21. In FIG. 2, both side walls 22 are shown, but in FIGS. 1 and 3 the front side wall has been removed to show the inner components of the roller assembly. The upper end of the housing 20 is narrower than the lower end such that the edges diverge slightly from top to bottom. Each side wall 22 defines a generally arcuate-shaped slot 24 at the bottom thereof, the slot 24 being open at the bottom. The housing 20 defines a cavity 26 therein and has an opening 28 at the lower end thereof. The lower end of each side wall 22 is provided with an outwardly laterally extending flange 30 which is disposed adjacent to and in contact with the outer lower surface 18*a* of the door 14 when the assembly is installed. Extending from each side wall 22 is a resilient locking member 32 which enables the housing 20 to be releasably locked into the recess 12. The locking members 32 are integral to the side walls 22 and have a free end provided with an abutment surface 34.

A roller carrier 36 is mounted in the cavity 26 to be adjusted vertically with respect to the housing 20. The roller carrier 36 consists of a pair of opposing corresponding plates 38, each of which is disposed adjacent the inner side of a housing wall 22. A substantially U-shaped groove 40 is provided at the upper end of each plate 38, the groove 40 being open at the top. The lower end of each plate 38 is provided with a contoured portion 42, as best seen in FIG. 2, which defines an outwardly extending circular flange 44. The U-shaped grooves 40 and circular flanges 44 are vertically aligned with one another. Projections 46, defining cam followers, extend inwardly from plates 38 between the grooves 40 and the outwardly extending flanges 44.

A camming element 48 is mounted within the housing 20 between the upper ends of the opposing plates 38. The camming element 48 defines an integral axle 50 which extends outwardly from each side of the camming element 48, as best seen in FIG. 2. The ends of the axle 50 are positioned within the U-shaped grooves 40 defined in the plates 38 and each end is rotatably supported in an aperture 54 defined through the upper end of each wall 22 of the housing 20, such that the axle end lies flush with the outer surface of the wall 22.

The lower end of the camming element 48 includes a substantially arcuate slot 56, into which the cam followers 46 extend. The upper end of the camming element 48 defines a plurality of gear teeth 58. An adjustment stem 60 extends sideways from the upper end of the housing 20. The adjustment stem 60 is provided with a threaded portion 62 which is disposed within the housing 20 and is adapted to engage and cooperate with the gear teeth 58 on the camming element 48 to rotate the camming element 48 about its axle 50 to thereby raise or lower the roller carrier 36 with respect to the housing 20. A second portion 64 of the adjustment stem 60 extends laterally outwardly from the housing 20 and extends through an aperture 66 provided in the side of the door frame 14, such that the end 68 of the adjustment stem 60 lies generally flush with the outer surface of the door frame side 70. A slot 72 is provided in end 68 of the adjustment stem 60 to enable it to be easily rotated and adjusted from outside the door frame 14.

A roller 74, defining an integral hub 76, is rotatably supported between the contoured portions 42 at the lower ends of the roller carrier plates 38. The hub 76 extends outwardly from each side of the roller 74 and is generally cylindrically-shaped so that it is supported in the circular flanges 44, as seen in FIG. 2. The outer periphery of the roller 74 defines a substantially U-shaped groove 78 which fits over the rail 80 provided on the track 16 on which the door frame 14 slides.

The installation of the adjustable roller assembly is accomplished by inserting the housing 20 into the recess 12. Because of the diverging slant of the locking members 32, the upper portions of the locking members 32 contact the second shoulders **12*b* of the slot 12 and are biased inwardly toward the sides of the housing 20 as the roller assembly 10 is pushed upwardly through the slot 12 until the free ends of the locking members 32 pass therethrough. At that point, the locking members 32 spring outwardly trapping the flat surface 18*a* defined by the recess 18 between the locking members 32 and the flanges 30, such that the abutment surfaces 34 of the locking members 32 contact the upper surface 82 of surface 18*a* and the upper surfaces of the flanges 30 are disposed adjacent and in contact with the lower surface of the surface 18*a*. When the roller assembly 10 is thus inserted, the sides of the housing 20 contact the first shoulders 12*a* and prevent lateral movement of the assembly 10 within the slot 12. The end 68 of the adjustment stem 60 is positioned to extend through the aperture 66 in the side of the door frame. The free ends of the locking members 32 are positioned approximately half-way across the respective notches 19. No tools are necessary for installation. When it is desired to remove the roller assembly 10 from the slot 12, an implement or tool is inserted through the open portions of the notches 19 and is used to press the locking members 32** inwardly to effect removal.

The roller carrier 36, and consequently the roller 74, may be adjusted vertically with respect to the housing 20 and door frame 14 from the side edge of the door frame after installation. The end of a screwdriver or such is positioned in the slot 72 at the end 68 of the adjustment stem 60 and rotated one way or the other depending upon whether it is desired to raise or lower the roller carrier 36 and roller 74. When the adjustment stem 60 is rotated, the threaded portion 62 in engagement with the gear teeth 58 on the camming element 48 act to rotate the camming element 48 about its axis 50. As the camming element 48 rotates, it has a camming effect on the cam followers 46 trapped in the arcuate slot 56 thereby causing the cam followers 46 to be pushed downwardly or raised upwardly depending on the direction of rotation of the adjustment stem 60. Since the cam followers 46 are integral with the plates 38, the roller carrier 36 and roller 74 are moved vertically downwardly or upwardly, respectively. The roller assembly 10 may be adjusted to take up the slack between the door frame 14 and the track 16 or to tighten the fit therebetween by lowering the roller 74. Conversely, the roller assembly 10 may be adjusted to increase the slack or loosen the fit therebetween by raising the roller 74.

While the above description describes a roller assembly which is installed in the lower edge of a door, it is understood that the roller assembly may also be installed in the upper edge of a door.

Thus it has been shown that the present invention provides an easily adjustable roller assembly for sliding doors which may be installed without tools.

Various features of this invention have been particularly shown and described in connection with the illustrated embodiment of the invention. However, it must be understood that these particular arrangements merely illustrate and that the invention is to be given its fullest interpretation within the terms of the appended claims.

What is claimed is:

1. An adjustable roller assembly for sliding doors including a housing adapted to be mounted in a recess in a door frame, said housing defining a cavity therein and having an opening at the lower end thereof, a roller carrier mounted within said cavity adjustable vertically with respect to said housing, said roller carrier defining circular flanges at either side thereof, a roller defining an integral hub rotatably in said carrier such that said hub is positioned within said circular flanges on either side of said roller, releasable locking means associated with said housing for snap-fitting and releasably locking said housing in said recess of said door frame for securement therein, adjustment means associated with said roller carrier for effecting said vertical adjustment of said roller carrier, said adjustment means including an adjustment stem threaded at one end and extending into said cavity and a camming element rotatably supported within said cavity and connected to said roller carrier, said camming element defining a plurality of gear teeth on its outer periphery engageable with said threads on said adjustment stem whereby rotation of said adjustment stem causes rotation of said camming element which effects vertical adjustment of said roller carrier and roller to vertically vary the position of said roller with respect to said housing to thereby adjust the slack between said sliding door and the surface on which it slides.

2. The adjustable roller assembly of claim 1 wherein said roller defines a groove around the outer periphery thereof adapted to receive a rail of a track.

3. The adjustable roller assembly of claim 1 wherein said adjustment stem extends into said cavity from a side edge of said door frame facilitating adjustment of said roller from a side of said door frame after installation thereof.

4. The adjustment roller assembly of claim 1 in which said adjustment means further include one or more cam followers connected to said roller carrier and an arcuate groove defined in said camming element, said cam follower extending into said groove whereby rotation of said camming element about its axis causes vertical movement of said cam follower, said roller carrier and said roller.

* * * * *